United States Patent [19]

Kaufmann et al.

[11] 4,252,153

[45] Feb. 24, 1981

[54] HEDDLE ROD HOOK DEVICE FOR A LOOM

[75] Inventors: Frank H. Kaufmann; Charles F. Kramer; Colin S. White, all of Greenville, S.C.

[73] Assignee: Steel Heddle Manufacturing Co., Greenville, S.C.

[21] Appl. No.: 32,287

[22] Filed: Apr. 23, 1979

[51] Int. Cl.[3] ..... D03C 9/06

[52] U.S. Cl. ..... 139/92

[58] Field of Search ..... 139/91, 92

[56] References Cited

U.S. PATENT DOCUMENTS

| | | | |
|---|---|---|---|
| 2,645,251 | 7/1953 | Haenny | 139/92 |
| 2,874,726 | 2/1959 | Kaufmann | 139/92 |

FOREIGN PATENT DOCUMENTS

| | | | |
|---|---|---|---|
| 2427573 | 12/1975 | Fed. Rep. of Germany | 139/92 |
| 2,610,311 | 9/1977 | Fed. Rep. of Germany | 139/92 |
| 703196 | 4/1966 | Italy | 139/92 |
| 244577 | 4/1947 | Switzerland | 139/92 |

*Primary Examiner*—Henry Jaudon

*Attorney, Agent, or Firm*—Bailey, Dority & Flint

[57] ABSTRACT

A rod hook device is disclosed for a heddle frame of a weaving loom for connecting a heddle rod to a frame slat of the heddle frame wherein the rod hook device includes a base portion receivable in a longitudinal groove formed in the frame slat provided with unique biasing means which facilitate sliding of the base in the groove while providing a tight engagement between shoulder means formed on the base portion and projections formed in the groove.

13 Claims, 4 Drawing Figures

HEDDLE ROD HOOK DEVICE FOR A LOOM

BACKGROUND OF THE INVENTION

Heretofore, heddle rod connectors have been provided for attaching a heddle rod to the frame slat of a heddle frame wherein the rod connector was either screwed to the slat or welded to the frame slat such as shown in U.S. Pat. No. 3,434,505. However, due to the constant up and down motion of the heddle frame during operation, the screws have a tendency to vibrate loose and the necessary perforations in the frame slat reduce the reflection strength and can result in premature slat failure through metal fatigue.

U.S. Pat. No. 4,112,980 discloses various arrangements of adhesively bonding a heddle rod holder device to a frame slat and is directed more particularly to noise and force transmission reduction utilizing various elastic elements.

SUMMARY OF THE INVENTION

It has been found that a rod hook device can be had according to the invention which provides an improved means of connecting a heddle rod in a heddle frame. The device includes a base portion slidable in a longitudinal groove formed in a side edge of a slat of the heddle frame and a shank portion integral with the base portion extending outwardly through a narrowed opening of the groove wherein shoulder means formed on the base portion is maintained in tight contact with projections formed in the groove by means of resilient curved fingers formed on the base portion which engage a bottom portion of the groove reducing play between the base portion and groove while permitting longitudinal sliding movement therebetween.

Accordingly, an important object of the present invention is to provide a rod hool device which may be easily assembled with a heddle frame slat to make connection between a heddle rod and the heddle frame on a weaving loom.

Another important object of the present invention is to provide a rod hook device for connecting heddle rods in a heddle frame which assure that the heddles held therein do their job uniformly in holding the warps in the same manner and position on each up and down movement by absorbing play at the end positions.

Another important object of the present invention is to provide a heddle rod hook device which may be inserted in an open top groove of a heddle frame slat which eliminates any play and wear of the rod hook member in the groove portion.

Yet another important object of the present invention is the provision of a rod hook device which may be inserted in the groove of a heddle frame slat which includes a uniquely constructed resilient biasing means for maintaining tight interlocking engagement between the rod hook and groove portions substantially eliminating any play therebetween due to tolerances.

Yet another important object of the present invention is the provision of a rod hook device which may be inserted in a longitudinal groove of a heddle frame slat wherein the rod hook includes resilient biasing means for maintaining the rod hook tightly in the groove while permitting it to slide easily in opposing longitudinal directions therein.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF THE PREFERRED EMBODIMENT

Figure 1:
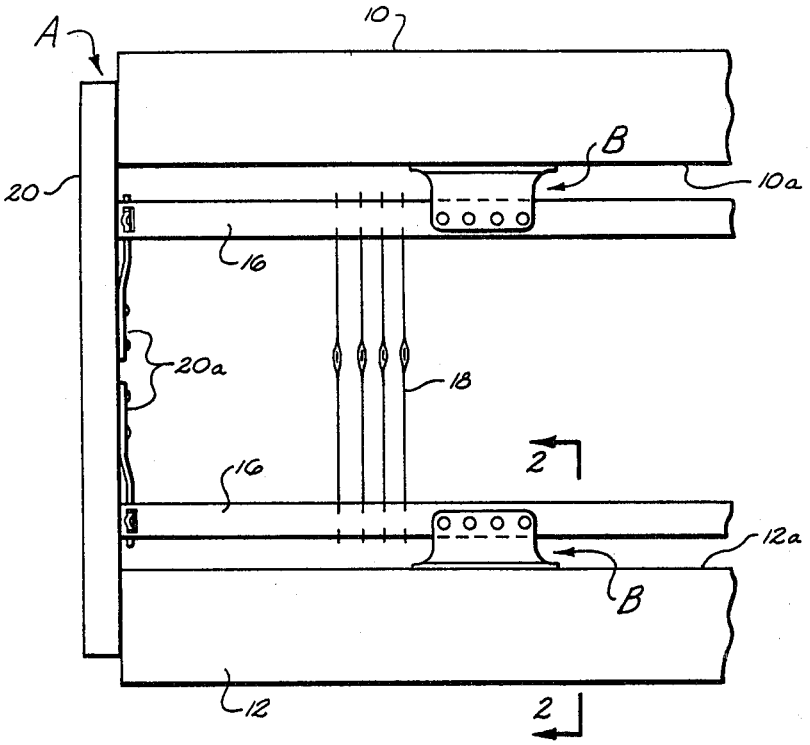
FIG. 1 is a front elevation illustrating a cutaway end portion of a heddle frame assembly for a weaving loom.
Figure 2:
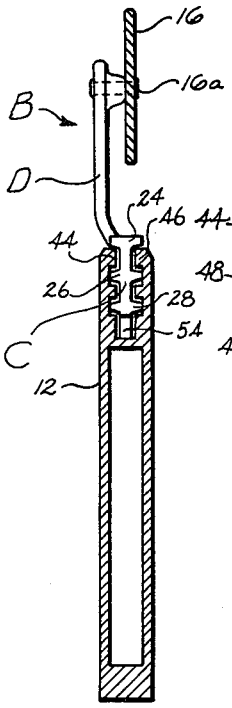
FIG. 2 is a sectional view taken along line 2—2 of FIG. 1.

The drawing illustrates that portion of a heddle frame of a weaving loom designated generally as A which is necessary for an understanding of the invention. The heddle frame A includes a top and bottom heddle frame slat 10 and 12 wherein each slat has an open-top longitudinal groove 14 formed in respective side edges 10*a* and 12*a*. The heddle frame further includes rod hook devices, designated generally as B, which connect to a heddle rod 16 between which heddles 18 are supported. The heddle frame is completed by side frame members 20 which secure the ends of the heddle rod 16 by means of clips 20*a* as illustrated.

Referring now in more detail to rod hook device B, the rod hook includes a base portion C slidably received in groove 14 and a shank portion D integral with the base portion which extends through the open top of the groove 14 when inserted therein and outwardly away from the side edge of the frame slat. Carried adjacent the end of the shank portion D is a thickened portion 22 having holes formed therein by means of which connection may be had with the heddle rod 16 such as by rivets 16*a*. Shoulder means E carried by the base portion C are provided for engaging inwardly extending end portion means of the sides of groove 14 for limiting relative lateral outward movement therebetween and retaining the base portion in the groove. Resilient means F carried by the base portion C of the rod hook device engages a rigid bottom portion of the groove biasing the shoulder means of the base portion and the inwardly projection means of the groove in a generally rigid interlocking configuration reducing play and resulting wear therebetween.

As illustrated, shoulder means E for retaining the base portion in groove 14 includes spaced flange means 24, 26, and 28 connected by web portions 30 and 32 which extend generally laterally in opposing directions from the web portions to define respective recess spaces 34 and 36 therebetween. Groove 14 is defined by spaced side walls 38 and 40 extending upwardly from a rigid bottom portion 42 wherein means for extending an end portion of the side walls inwardly to engage the shoulders of the base includes inwardly extending projection means adjacent the end of each side wall as illustrated at 44 and 46 which are received in space 34 on opposing sides of web 30. Additional groove projections 48 and 50 extend inwardly into recessed spaces 36 on opposing sides of web 32. Inwardly extending end portions 44 and 46 terminate to define a slot having an opening 52 narrowed relative to bottom portion 42 through which shank D extends outwardly away from the respective side edge of the frame slat.

It will be noted that flanges 24 and 26 provide upper and lower flange means engaging opposing upper and lower surfaces of end projection portions 44 and 46 thereby limiting relative lateral outward movement between the base portion C in groove 14. Additional lower flange means 28 and projections 48 and 50 enhance the rigid interlocking engagement between the base and groove.

Resilient means F is provided by curved flexible finger elements 54 integrally carried on the bottom of base portion C which, as illustrated, includes flange means 28. The finger elements 54 project downwardly to resiliently engage the rigid bottom portion 42 of groove 14 when inserted therein and bias the base portion C upwardly providing a snug engagement between the corresponding cooperating shoulder means of the base portion and projections of the groove assuring a tight generally rigid interlocking configuration.

In the preferred form, rod hook device B includes shank portion D, base portion C, and resilient fingers 54, formed as a single piece of extruded or molded plastic. The flexible biasing fingers 54 compensate for tolerance inaccuracies in the forming of the base portion C and the respective portions of groove 14 so as to take up any play therebetween and reduce wear which normally causes increased play and further wear. This can particularly be appreciated when considering the constant up and down motion of the heddle frame countless numbers of times day in and day out which results in push and pull between the frame slat groove 14 and rod hook device B transmitted through the heddle rod 16 as the warps held in the eyes of heddles 18 are raised and lowered during weaving.

Figure 3:
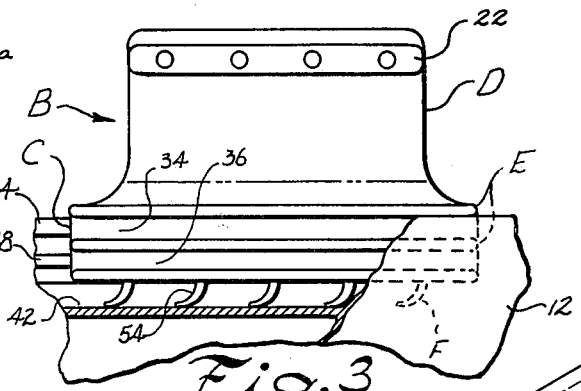
FIG. 3 is a front elevation illustrating a rod hook device constructed according to the invention with part of the heddle frame slat cut away, illustrating the position of the rod hook device in the groove thereof.
Figure 5:
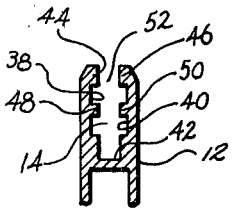
FIG. 5 is a sectional view taken across the longitudinal groove of the heddle frame slat with the rod hook device removed.
Figure 4:
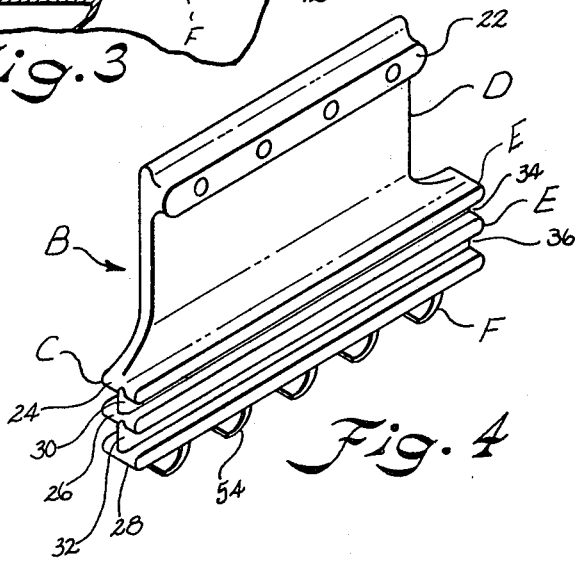
FIG. 4 is a perspective view illustrating a rod hook device according to the invention.

As best seen in FIG. 3, the finger elements 54 are inclined in a curved configuration and are sufficiently flexible whereby a portion of the bottom surface of each curved finger generally assumes a tangential or parallel orientation with the bottom of the groove 14 facilitating sliding movement therebetween in opposing longitudinal directions in the groove. By so biasing the rod hook B in groove 14, a more nearly uniform job can be had by the heddle frame in the weaving operation whereby the warp yarns are raised and lowered and tensioned more uniformly at each stroke of the heddle frame due to substantial elimination of play at the end positions by removal of slack by the flexible fingers. The resulting reduction in play results in a longer life of the parts.

While a preferred embodiment of the invention has been described using specific terms, such description is for illustrative purposes only, and it is to be understood that changes and variations may be made without departing from the spirit of scope of the following claims.

What is claimed is:

1. A rod hook device for making connection to the heddle rod of a heddle frame of a weaving machine of the type wherein the heddle frame includes opposing top and bottom frame slats, each said slat having an open longitudinal groove formed in a side edge thereof, each said groove defined by a bottom portion and spaced side walls having inwardly extending end portion means defining an open slot therebetween having an opening narrowed relative to said bottom portion, said rod hook device comprising:

a base portion slidably receivable in said longitudinal groove;

a shank portion integral with said base portion for extending through said open slot of said groove outwardly therefrom away from said frame slat side edge, means carried by said shank portion for making connection with said heddle rod, shoulder means carried by said base portion adapted for engaging said inwardly extending end portion means adjacent said narrowed slot opening of said groove limiting lateral outward movement thereof retaining said base portion in said groove, and resilient means carried by said base portion of said rod hook device for engaging said bottom portion of said groove urging said shoulder means of said base portion tightly against said end portion of said groove reducing play and wear therebetween.

2. The device of claim 1 wherein said resilient means includes a plurality of inclined flexible finger elements projecting from said base portion.

3. The device of claim 2 wherein said finger elements are inclined in a curved configuration wherein a portion of the bottom surface of each said curved finger generally assumes a tangential contact with said bottom of said groove facilitating sliding movement therebetween.

4. The device of claim 1 wherein said shoulder means includes upper and lower flange means joined by web means, said flange means extending generally laterally beyond said web means defining a recess space therebetween for receiving said inwardly extending end portion means of said groove.

5. The device of claim 4 wherein said flange means extend laterally in opposing directions to define said recess space means on opposing sides of said web means and wherein said inwardly extending end portion means includes projections adjacent the ends of both said side walls receivable in said opposing recess spaces.

6. The device of claim 1 wherein said resilient means includes a plurality of curved flexible finger elements projecting downwardly from said base means to engage said bottom portion of said groove.

7. The device of claim 6 wherein said rod hook device including said shank portion, base portion and finger elements is constructed as a single piece of plastic.

8. In a heddle frame for a weaving machine of the type wherein the heddle frame includes opposing top and bottom frame slats, each said slat having an open longitudinal groove formed in a side edge thereof for receiving a rod hook device for making connection between the frame slats and a heddle rod on which heddles are carried wherein the improvement comprises:

each said groove being defined by a rigid bottom portion and spaced side walls having inwardly extending end portion means defining an open slot between said side walls having an opening narrowed relative to said bottom portion;

said rod hook device including a base portion slidably receivable in said longitudinal groove and a shank portion integral with said base portion extending through said open slot of said groove outwardly therefrom away from said frame slat side edge adapted for making connection with said heddle rod, shoulder means carried by said base portion of said rod hook device engaging said end portion means adjacent said narrowed slot opening of said side walls of said groove limiting lateral outward movement thereof and retaining said base portion in said groove, and resilient means carried by said base portion of said rod hook device engaging said bottom portion of said groove biasing said shoulder means of said base portion and said end portion means of said groove in a tight interlocking configuration reducing play and wear therebetween.

9. The device of claim 8 wherein said inwardly extending end portion means includes projection means extending inwardly adjacent ends of each said side wall.

10. The device of claim 8 wherein said shoulder means includes upper and lower flange means joined by web means, said flange means extending generally laterally beyond said web means defining a recess space therebetween receiving said inwardly extending end portion means of said groove.

11. The device of claim 10 including second lower flange means joined by second web means to said first mentioned lower flange means, said second lower flange means extending beyond said second web means defining a second recess space between said second and first lower flange means, said groove including projection means receivable in said second recess space.

12. The device of claim 8 wherein said resilient means includes a plurality of inclined flexible finger elements projecting from said base portion.

13. The device of claim 12 wherein said finger elements are inclined in a curved configuration wherein a portion of the bottom surface of each said curved finger generally assumes a tangential contact with said bottom of said groove facilitating sliding movement therebetween.

* * * * *